US005676362A

United States Patent [19]

Ferraris

[11] Patent Number: 5,676,362

[45] Date of Patent: Oct. 14, 1997

[54] VACUUM-TYPE TRANSPORT DEVICE FOR PRINTING UNITS FOR PACKAGING CARDBOARD SHEETS

[75] Inventor: Giancarlo Ferraris, Villa Del Foro, Italy

[73] Assignee: Texo S.R.L., M.TO. (Allessandria), Italy

[21] Appl. No.: 522,678

[22] Filed: Sep. 1, 1995

[51] Int. Cl.[6] ..... B65H 5/22

[52] U.S. Cl. ..... 271/3.14; 271/3.18; 271/3.2; 271/3.22; 271/3.23; 271/276; 271/197

[58] Field of Search ..... 271/3.14, 3.18, 271/3.2, 3.22, 3.23, 7, 276, 69, 197, 272, 314; 101/232; 198/689.1

[56] References Cited

U.S. PATENT DOCUMENTS 4,096,941 6/1978 Tokuno ..... 271/197 X 5,201,513 4/1993 Mion ..... 271/197 X 5,564,693 10/1996 Elkis et al. ..... 271/197 X

*Primary Examiner*—David H. Bollinger

*Attorney, Agent, or Firm*—Helfgott & Karas, P.C.

[57] ABSTRACT

A vacuum-type transport device, used in cardboard printing units, comprising: a support structure; a suction hood; a vacuum fan; a plurality of plates on the lower surface of the suction hood; a first and a second plurality of belt-type conveyor means, with a pressure cylinder between them, that protrude from windows obtained in the lower surface of the suction hood; and motoring means for the device. The pressure cylinder is located next to the printing cylinder and the sheets of material to be printed pass between these cylinders and are dragged away by the belt-type conveyor means.

3 Claims, 2 Drawing Sheets

VACUUM-TYPE TRANSPORT DEVICE FOR PRINTING UNITS FOR PACKAGING CARDBOARD SHEETS

BACKGROUND OF THE INVENTION

1. Field of the Invention

The present invention deals with a vacuum-type transport device for printing units, located in production lines for cardboard sheets for packaging and the like.

2. Background Information

It is known in the art a type of "traditional" transport device for cardboard sheets along the lines where cutting, printing, drying and stacking are performed together with the other typical operations when producing materials for packagings. Substantially, this transport device includes a plurality of opposed conveyor rollers, which, however, have quality problems as regards the final product, above all in printing units. In particular, when short sheets (that is, whose length is less than the distance between two pairs of following conveyor rollers) are transported, they can enter the gap between the rollers; a similar problem occurs when "warped", that is curved, sheets are conveyed. Moreover, printing blurs are generated, produced by the contact with transport wheels. Finally, cover distortions are generated, due to squashing between pairs of support wheels.

SUMMARY OF THE INVENTION

Purpose of the present invention is solving all the above problems, providing a transport system that, by applying the vacuum-type transport technique from the above, allows better dragging sheets in general, and short or warped sheets in particular, in addition to a transport by contact on a single surface, that is the one free from printings, with following removal of the above-said blurs. Finally, the device of the present invention allows realizing a vacuum-type transport with related absence of cover distortions.

The above and other purposes and advantages of the invention, as will appear from the following description, are obtained with a vacuum-type transport device substantially comprising:

an external support structure;

a suction hood located inside said support structure; and a vacuum fan located in an upper part of said suction hood;

a plurality of plates located on a lower surface of said suction hood;

a first plurality of belt-type conveyor means located downstream of an inlet to said printing unit, said first plurality of belt-type conveyor means protruding from a first plurality of windows obtained in said lower surface of said suction hood;

a pressure cylinder located downstream of said first plurality of belt-type conveyor means, said pressure cylinder being located next to a printing cylinder of said printing unit, said sheets of material to be printed being adapted to pass between said pressure cylinder and said printing cylinder;

a second plurality of belt-type conveyor means located downstream of said pressure cylinder, said second plurality of belt-type conveyor means protruding from a second plurality of windows obtained in said lower surface of said suction hood; and motoring means for the device, a speed of said motoring means being equal to a peripheral speed of said printing unit.

wherein the device is used in printing units for sheets of materials for packagings.

The present invention will be better described by some preferred embodiments thereof, provided as a non limiting example, with reference to the accompanying drawings.

DESCRIPTION OF PREFERRED EMBODIMENTS

Figure 1:
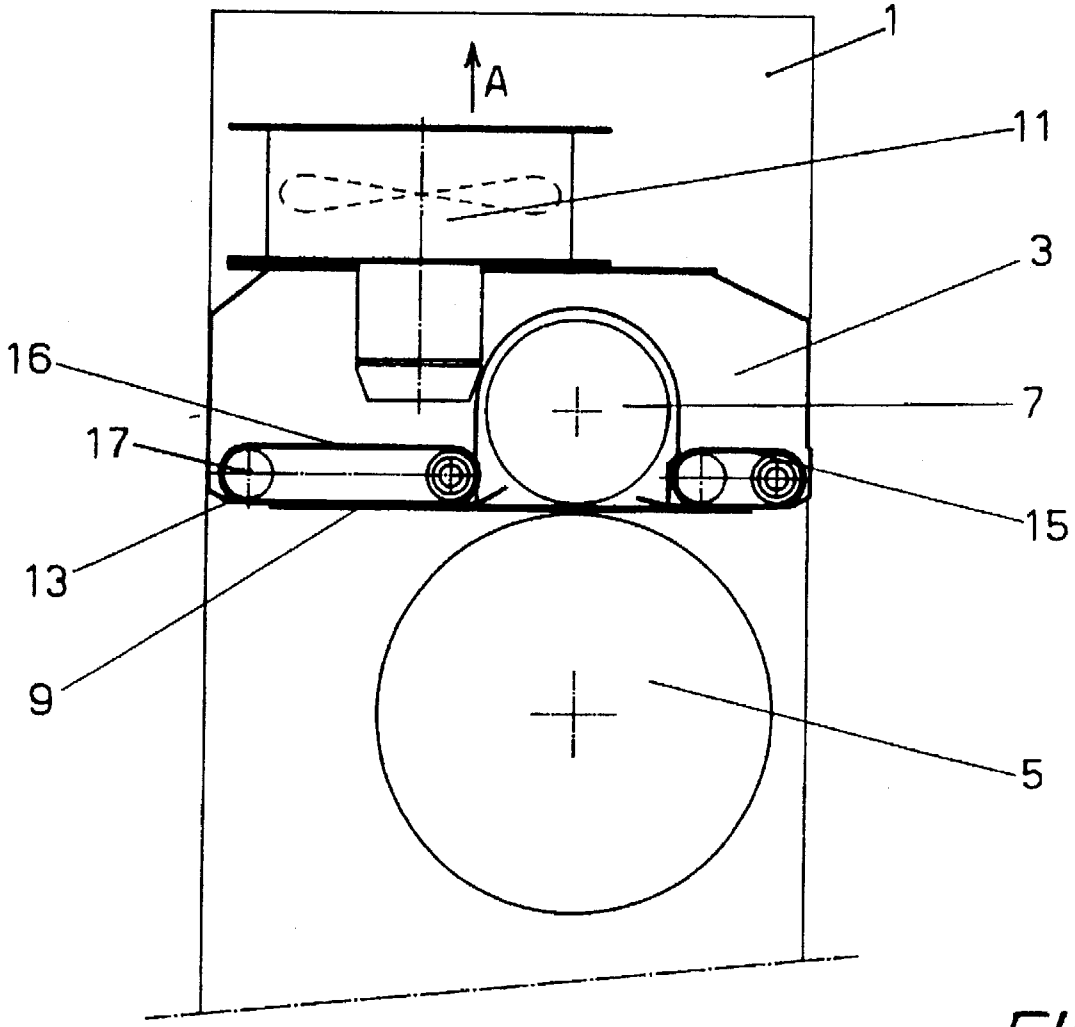
FIG. 1 is a side view of an embodiment of the vacuum-type transport device of the present invention.
Figure 2:
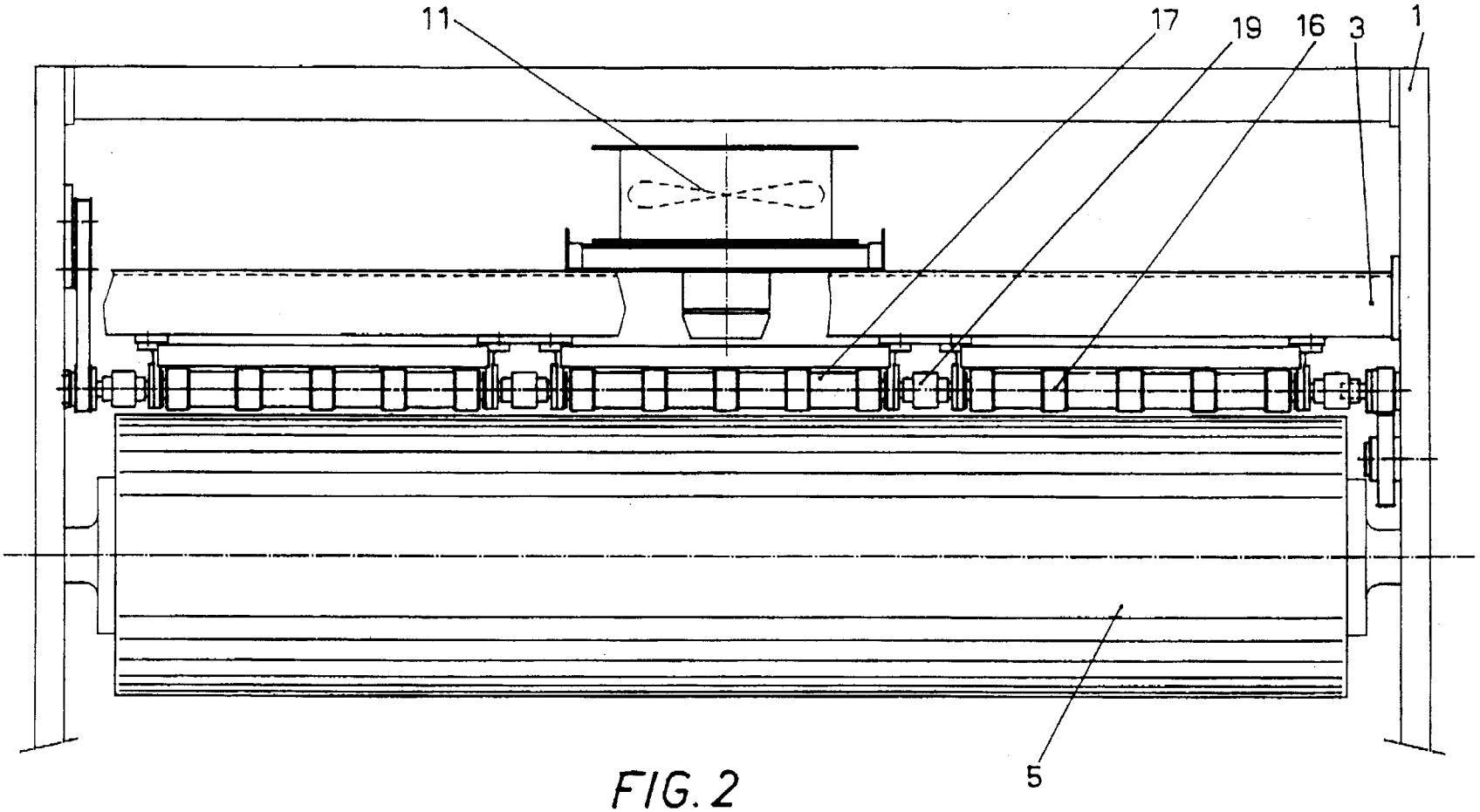
FIG. 2 is a front view of the vacuum-type transport device in FIG. 1.

With reference to the Figures, the device for vacuum transporting, in printing units, cardboard shapes or other materials for packaging, substantially comprises an external support structure 1 containing a suction hood 3 located above a printing cylinder 5. The suction hood 3 contains a pressure cylinder 7, that acts contrast cylinder with the printing cylinder 5 to hold and print cardboard sheets 9: in fact, the pressure cylinder 7 is placed in such a way as to be tangent, in the lower part thereof, to the plane where a sheet 9 being printed, rests.

Inside the suction hood 3 a vacuum is created through the action of a helical fan 11 that is located in the upper part of the hood 3 and that exhausts upwards, along the direction shown by arrow A in FIG. 1.

The lower surface of the suction hood 3 is transversally open in the central area thereof, from which the above-said pressure cylinder 7 protrudes, and shows a set of plates 13 in which two series of rectangular windows are obtained, that are parallel one with the other (a series is upstream and the other series is downstream of the pressure cylinder 7) and through which a first plurality of conveyor belts 15 upstream of the pressure cylinder 7, and a second plurality of conveyor belts 16 downstream of the pressure cylinder 7, are surfacing, protruding for about 1 mm.

The belts 15 are engaged with the window section in the central area and then around them an empty frame is realized, through which air and/or the sheet 9 are sucked, in such a way as to keep the latter one adherent against the conveyor belts 15 themselves. The belts 15 are motored, getting their motion from the gear transmission of the printing unit (not shown), and have the same speed as the peripheral speed of the other cylinders of the printing unit itself.

The pulley shafts 17 are placed as a plurality of sections, that are mutually connected by stiff joints 19 to make maintenance easier.

The fan 11 generating the vacuum inside the hood 3 is adjustable, as regards motor speed, through a common inverter (not shown).

Although the present invention has been described with refernce to preferred embodiments, numerous modifications and rearrangements can be made, and still the result will come within the scope of the invention.

We claim:

1. A vacuum-type transport device substantially comprising:

an external support structure;

a suction hood located inside said support structure; and a vacuum fan located in an upper part of said suction hood;

a plurality of plates located on a lower surface of said suction hood;

a first plurality of belt-type conveyor means located downstream of an inlet to said printing unit, said first plurality of belt-type conveyor means protruding from a first plurality of windows obtained in said lower surface of said suction hood;

a pressure cylinder located downstream of said first plurality of belt-type conveyor means, said pressure cylinder being located next to a printing cylinder of said printing unit, said sheets of material to be printed being adapted to pass between said pressure cylinder and said printing cylinder;

a second plurality of belt-type conveyor means located downstream of said pressure cylinder, said second plurality of belt-type conveyor means protruding from a second plurality of windows obtained in said lower surface of said suction hood; and motoring means for said device, a speed of said motoring means being equal to a peripheral speed of said printing unit;

wherein said device is used in printing units for sheets of materials for packagings.

2. A vacuum-type transport device according to claim 1, wherein said shafts moving said first and second plurality of belt-type conveyor means are composed of a plurality of sections mutually connected through stiff joints.

3. A vacuum-type transport device according to claim 1, wherein a speed of said fan adjusted by an inverter.

* * * * *